United States Patent [19]

Hou

[11] Patent Number: 5,006,416

[45] Date of Patent: Apr. 9, 1991

[54] STATIONARY DISPLAY UNIT

[76] Inventor: Jack Hou, 3 Fl, No. 8, Lane 7, Wu Hsing Street, Taipei, Taiwan

[21] Appl. No.: 466,642

[22] Filed: Jan. 17, 1990

[51] Int. Cl.[5] ..... B44C 3/06

[52] U.S. Cl. ..... 428/542.2; D11/159; D21/70; 428/16

[58] Field of Search ..... D11/159, 162; D21/70, D21/249; 446/241; 428/328, 7, 16, 542.2, 542.4

[56] References Cited

U.S. PATENT DOCUMENTS

| | | | |
|---|---|---|---|
| D. 158,192 | 4/1950 | Hettick | D21/249 X |
| D. 163,620 | 6/1951 | McMonagle | D11/159 X |
| D. 235,594 | 7/1975 | Cohn | D21/249 X |
| 843,406 | 2/1907 | Mangels | D21/249 X |
| 2,992,009 | 7/1961 | Dimitriadis | D21/70 X |
| 2,996,298 | 8/1961 | Grosse et al. | D21/70 X |
| 4,105,812 | 8/1978 | Campbell, Jr. | 428/16 X |

*Primary Examiner*—Henry F. Epstein
*Attorney, Agent, or Firm*—Bacon & Thomas

[57] ABSTRACT

An ornamental figure is mounted on a vertical support rod by a rubber grommet, with the lower end of the rod being secured to a base assembly including a casing and bottom plate. A spacer member disposed between the casing and plate prevents deformation of the casing during threaded attachment of the rod to the plate.

7 Claims, 2 Drawing Sheets

STATIONARY DISPLAY UNIT

BACKGROUND OF THE INVENTION

1. Field of the Invention

The invention generally involves the field of technology pertaining to ornamental display devices. More particularly, the invention relates to an improved construction of a stationary unit for displaying ornamental objects.

2. Description of the Prior Art

Stationary display devices and units for exhibiting ornaments or simulated figures are well known in the prior art. A device of this type typically includes a base or platform on which an upwardly extending support member is provided for mounting an ornament thereon. For example, the device may be used to display a delicate porcelain or ceramic figure. In such case, it is important that the components forming the assembly have an appropriate quality appearance in order to compliment the ornament being displayed.

Display devices for ornaments are often mass produced, with their manufacture and assembly occurring at different locations. For example, some of the parts or components of a device may be manufactured in one country, and thereafter shipped to another country for assembly. It is always the objective of the manufacturer to provide the highest quality product at the minimum cost in order to maximize sales and profits. In order to realize this objective, a display device should ideally be designed so as to require a minimum of components which may be economically manufactured and easily assembled to produce a product having a quality appearance.

SUMMARY OF THE INVENTION

It is an object of the invention to provide an improved stationary display unit having a high quality appearance.

It is another object of the invention to provide a high quality stationary display unit which is economical to manufacture.

It is a further object of the invention to provide an improved stationary display unit which is extremely simple to assemble from premanufactured components.

These and other objects of the invention are realized by providing a stationary display unit which comprises a base assembly that includes top and bottom portions secured together by a threaded rod inserted through the top portion and threadedly engaged to the bottom portion. A resilient grommet is frictionally and slidably engaged onto the rod for supporting an ornament thereon in a desired position. The top portion of the base assembly may be formed from thin brass which is prevented from deforming during engagement of the rod to the bottom portion due to the presence of a spacer member which maintains opposed surfaces of the top and bottom portions in a spaced disposition from each other.

Other objects, advantages and features of the invention shall become apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figure 1:
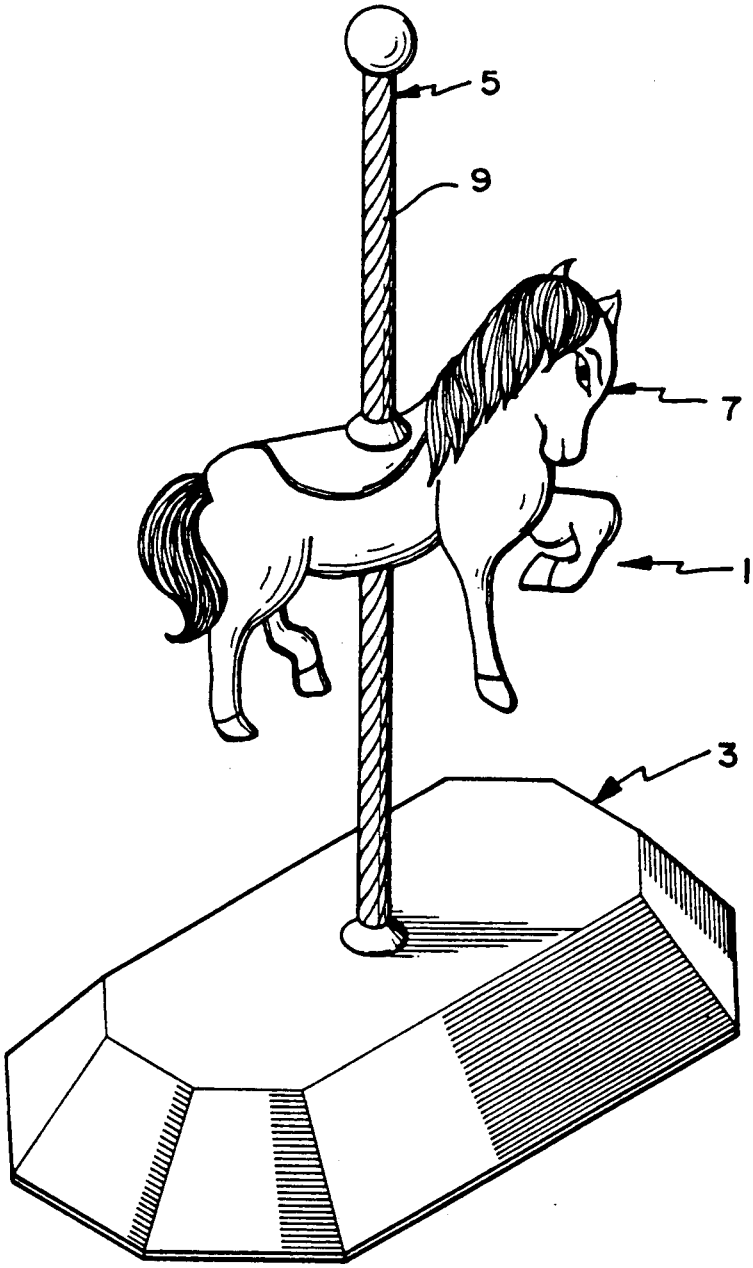
FIG. 1 is a perspective view of a stationary display unit according to a preferred embodiment of the invention.

An ornament display unit 1 according to a preferred embodiment of the invention shall now be described with initial reference to FIG. 1. As shown therein, unit 1 comprises a base assembly 3 and a support rod 5 extending upwardly therefrom. An ornament 7 is mounted on a main section 9 of support rod 5 for display. Ornament 7 is shown as a substantially hollow horse figure which may be formed from ceramic, porcelain or any other such material. It is also understood that ornament 7 may be of any other desired configuration or material.

Figure 2:
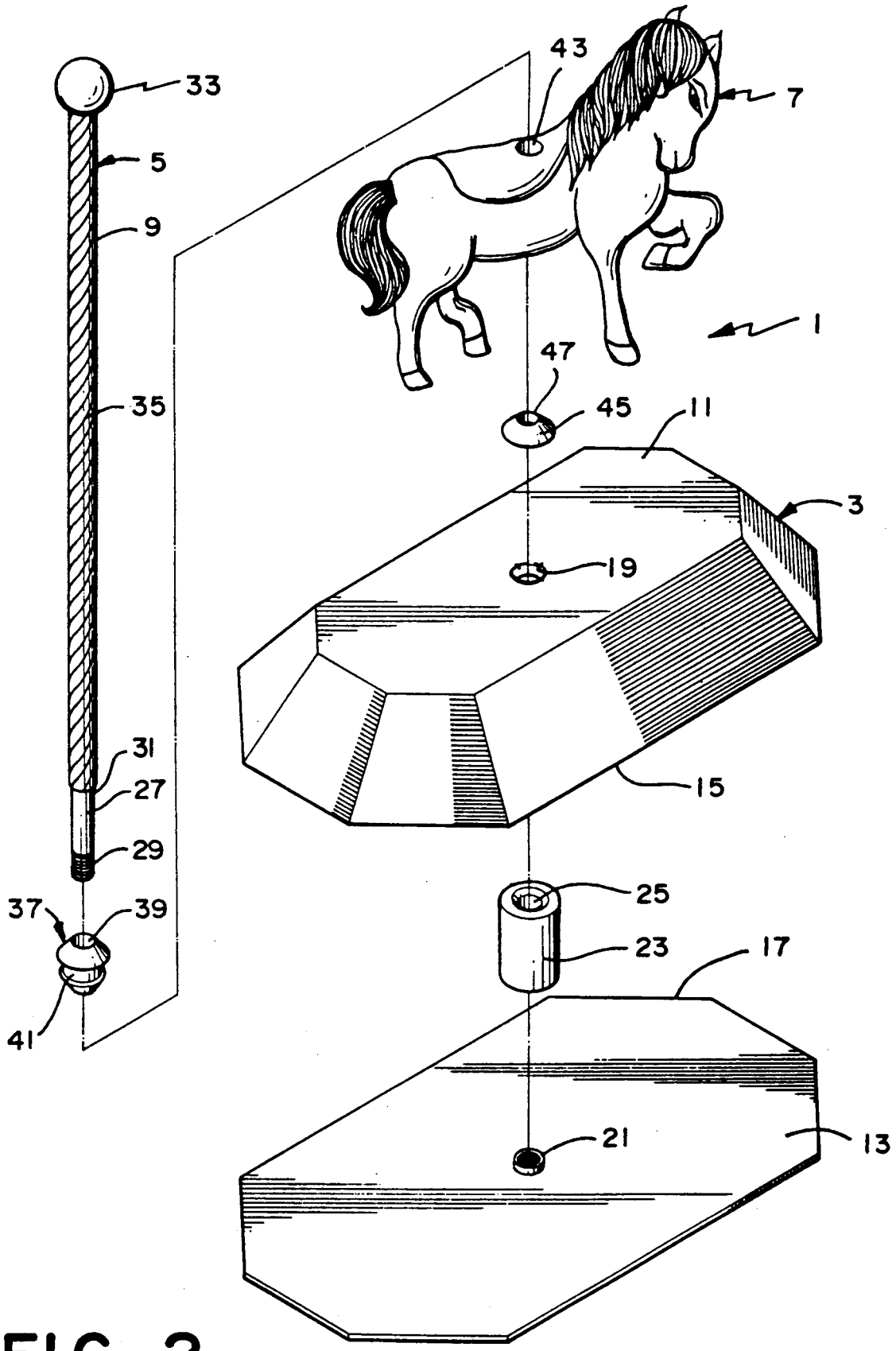
FIG. 2 is an perspective view of the unit, and particularly depicting the individual components forming the unit and the manner in which they are assembled together.

The details of the components forming unit 1 shall now be described with reference to FIG. 2. Base assembly 3 includes a top portion that is preferably in the form of a hollow casing 11 and a bottom portion that is preferably in the form of a flat plate 13. Casing 11 includes a lower peripheral edge 15 that corresponds in configuration to an outer peripheral edge 17 of plate 13. When casing 11 and plate 13 are assembled together in the manner shown in FIG. 1, edges 15 and 17 are disposed adjacent each other, thereby forming an enclosed compartment defined by the opposed inner wall surfaces of casing 11 and plate 13. Casing 11 is also provided with a centrally positioned aperture 19 therethrough and plate 13 is also provided with a corresponding centrally positioned threaded aperture 21 therethrough. Aperture 21 may be formed in any manner well known in the art, such as by threading a predrilled hole through plate 13, securing a threaded bushing to such predrilled hole, or associating a threaded nut therewith. Apertures 19 and 21 are disposed in coaxial alignment with each other when casing 11 and plate 13 are assembled in the manner shown in FIG. 1.

A spacer member 23, preferably of cylindrical configuration, is provided with a longitudinal passageway 25 therethrough. Spacer member 23 is disposed within the compartment formed by base assembly 3, with passageway 25 being positioned in coaxial alignment with apertures 19 and 21. The length of spacer member 23 is sufficient to dispose the opposite ends thereof in abutting engagement with the opposed inner wall surfaces of casing 11 and plate 13 to maintain a desired spacing therebetween.

Support rod 5 is preferably of cylindrical configuration and includes a first end defined by a reduced diameter section 27 which terminates in a threaded section 29, the latter corresponding to threaded aperture 21 for engagement therein. Section 27 defines a transverse annular wall section 31. The second or free end of support rod 5 may be provided with a decorative member 33 in the form of a sphere or other desired configuration. The major portion of main section 9 of rod 5 extending between member 33 and annular wall section 31 may be provided with a decorative helical groove 35 along the length thereof.

A resilient grommet 37, preferably formed of rubber or similar material, is provided with a central passageway 39 sized for frictionally engaging and slidably receiving main section 9 of rod 5 therethrough. Because of such frictional engagement, grommet 37 may be selectively positioned along main section 9 of rod 5 for supporting ornament 7 thereon, as shown in FIG. 1. The attachment of ornament 7 to grommet 37 is realized by providing an annular groove 41 in grommet 37, the width of groove 41 corresponding to the thickness of the wall forming ornament 7, the latter being hollow and provided with a pair of axially aligned apertures 43 formed in opposed wall portions thereof. Rod 5 is received through apertures 43 and grommet 37 is engaged around the periphery of the uppermost aperture 43, thereby mounting ornament 7 in a desired position on rod 5. Though ornament 7 may be mounted on rod 5 through the use of grommet 37, it is understood that other means may also be utilized in the practice of the invention. For example, rod 5 may be formed in two pieces and secured together with a threaded shaft that extends through apertures 43 of ornament 7.

A decorative washer member 45 is provided with a central aperture 47 corresponding in diameter to reduced diameter section 27 of rod 5. Thus, section 27 may be inserted through aperture 47 of washer member 45, aperture 19 in casing 11 and longitudinal passageway 25 of spacer member 23 so that threaded section 29 may be engaged within threaded aperture 21. When this assembly is realized, annular wall section 31 is disposed in abutting engagement against washer member 45.

An important advantage afforded by the invention resides in the provision of spacer member 23, washer member 45 and annular wall section 31 of rod 5. By virtue of this configuration, it is possible to form casing 11 from very thin brass or other quality decorative material without damaging casing 11 during assembly of unit 1. This is because annular wall section 31 engages the upper surface of washer member 45, thus urging the latter against the upper surface of casing 11 and compressing same against spacer member 23. The presence of spacer member 23 prevents casing 11 from being deformed or crushed inwardly during the threaded engagement of threaded section 29 in threaded aperture 21. Thus, base assembly 3 may be economically formed and easily assembled to provide a high quality appearance which shall compliment ornament 7 being displayed by unit 1.

Support rod 5 and washer member 45 may be formed of metal, such as brass, and spacer 23 is preferably formed of plastic. Bottom plate 13 may also be formed of metal.

It is to be understood that the form of the invention herein shown and described is to be taken as a preferred embodiment thereof, and that various changes in shape, material, size and arrangement of parts may be resorted to without departing from the spirit of the invention or scope of the subjoined claims.

I claim:

1. A display unit comprising:

(a) a base assembly including a top portion and a bottom portion, the top portion being provided with a first aperture through a wall thereof;

(b) a spacer member disposable between opposed surfaces of the top and bottom portions for maintaining the surfaces at a predetermined distance from each other, the spacer member including a longitudinal passageway therethrough;

(c) the first aperture and longitudinal passageway being disposable in coaxial alignment;

(d) a support rod including a first end insertable through the first aperture and longitudinal passageway;

(e) cooperating means for attaching the first end of the rod to the bottom portion and positioning the rod to extend outwardly of the base assembly; and (f) means for mounting an ornament on the rod.

2. The display unit of claim 1 wherein the cooperating means includes a threaded aperture in the bottom portion disposable in coaxial alignment with the first aperture and longitudinal passageway, and a correspondingly threaded section provided on the first end of the rod for threaded engagement within the threaded aperture.

3. The display unit of claim 1 wherein the mounting means includes a resilient grommet having a central passage through which the rod is slidably received, the central passage being sized to provide frictional engagement between the grommet and the rod.

4. The display unit of claim 3 wherein the grommet further includes an annular groove for engaging the periphery of a correspondingly sized aperture formed in the wall of a hollow ornament.

5. The display unit of claim 1 wherein the first end of the rod includes a reduced diameter section defining a transverse annular wall section, and further including a washer member provided with a central passage sized for receiving the reduced diameter section therethrough and disposable in abutting engagement against both the annular wall section and top portion to limit the degree of insertion of the rod through the first aperture.

6. The display unit of claim 1 wherein the top portion is substantially in the form of a casing, the bottom portion is substantially in the form of a flat plate, wherein the casing and flat plate collectively define a substantially enclosed compartment when assembled together and the spacer member being engageable against opposed inner surfaces of the compartment.

7. A stationary display unit comprising:

(a) a base assembly including an upper casing and a bottom plate collectively defining an enclosed compartment when assembled together, the casing being provided with a first aperture therethrough and the bottom plate being provided with a threaded aperture therethrough;

(b) a spacer member provided with a longitudinal passageway therethrough, the spacer member being disposed within the compartment in engagement against opposed inner wall surfaces of the casing and bottom plate for maintaining same at a predetermined distance from each other, and the longitudinal passageway being positioned between and in coaxial alignment with the first and threaded apertures;

(c) a cylindrical support rod including a first end provided with a reduced diameter section defining a transverse annular wall section and terminating in a threaded section, the reduced diameter section being received through the first aperture and the longitudinal passageway, and the threaded section being threadedly engaged within the threaded aperture;

(d) a washer member carried by the reduced diameter section of the rod and disposed in abutting engagement against both the annular wall section and an outer surface of the casing;

(e) a resilient grommet slidably received on the rod and disposed in frictional engagement therewith to permit selective positioning of the grommet along the length of the rod, the grommet including an annular groove; and (f) a substantially hollow ornament slidably received on the rod, the ornament including an aperture through a wall thereof, and the peripheral edge of the aperture being engaged within the annular groove of the grommet.

* * * * *